US011591056B2

(12) United States Patent
Hosono et al.

(10) Patent No.: US 11,591,056 B2
(45) Date of Patent: Feb. 28, 2023

(54) MARINE VESSEL

(71) Applicant: MITSUBISHI HEAVY INDUSTRIES, LTD., Tokyo (JP)

(72) Inventors: Kazuki Hosono, Tokyo (JP); Makoto Kawabuchi, Tokyo (JP); Takuyoshi Yamada, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 276 days.

(21) Appl. No.: 17/137,604

(22) Filed: Dec. 30, 2020

(65) Prior Publication Data

US 2021/0221489 A1 Jul. 22, 2021

(30) Foreign Application Priority Data

Jan. 17, 2020 (JP) ..... JP2020-005891

(51) Int. Cl.
*B63H 5/125* (2006.01)
*B63H 5/08* (2006.01)
*B63H 21/17* (2006.01)

(52) U.S. Cl.
CPC ..... *B63H 5/125* (2013.01); *B63H 5/08* (2013.01); *B63H 21/17* (2013.01)

(58) Field of Classification Search
CPC ..... B63H 5/125; B63H 5/08; B63H 21/17
See application file for complete search history.

(56) References Cited

U.S. PATENT DOCUMENTS

2005/0164574 A1 7/2005 Levander

FOREIGN PATENT DOCUMENTS

| | | | | |
|---|---|---|---|---|
| EP | 2821334 | | 1/2015 | |
| JP | 62-095999 | | 6/1987 | |
| JP | 09-142391 | | 6/1997 | |
| JP | 2005-526665 | | 9/2005 | |
| JP | 2007-022447 | | 2/2007 | |
| JP | 2010-195382 | | 9/2010 | |
| WO | WO-03066428 | A1 * | 8/2003 | ..... B63H 25/42 |
| WO | 03/099651 | | 12/2003 | |
| WO | WO-2006056654 | A1 * | 6/2006 | ..... B63B 1/08 |
| WO | 2010/140357 | | 12/2010 | |
| WO | 2013/119175 | | 8/2013 | |
| WO | 2014/123465 | | 8/2014 | |

* cited by examiner

*Primary Examiner* — Stephen P Avila
(74) *Attorney, Agent, or Firm* — Wenderoth, Lind & Ponack, L.L.P.

(57) ABSTRACT

A marine vessel capable of improving propulsion efficiency for the entire operation of the marine vessel. In the marine vessel, which includes a hull and a propeller provided on a stern side of the hull, $n^2D/\sqrt{(Bd)}$ is 4 or more and 35 or less, in a case where n is the number of the propeller, D is a diameter of the propeller, B is a water line breadth of the hull, and d is a draft of the hull.

20 Claims, 14 Drawing Sheets

MARINE VESSEL

CROSS-REFERENCE TO RELATED APPLICATIONS

This application claims the benefit of priority to Japanese Patent Application Number 2020-005891 filed on Jan. 17, 2020. The entire contents of the above-identified application are hereby incorporated by reference.

TECHNICAL FIELD

The disclosure relates to a marine vessel.

RELATED ART

The propulsion efficiency of a marine vessel is determined by: the resistance of the hull, the propeller efficiency, and the mutual influence of the hull and the propeller, and there is a recent trend toward reducing the burden on the global environment, requiring unprecedented high efficiency. In addition, the regulation of exhaust gas for marine vessels is about to start, and these days, a shift is in progress from a diesel engine using light oil, which has been the mainstream solution to a gas turbine and a steam turbine using a low-sulfur component fuel such as LNG. In this regard, electrification of marine vessels has progressed, and at the same time, consideration of hulls and propellers suitable for electrification is thought to be in progress.

In a conventional engine-driven propeller, since it is necessary to arrange the engine in the marine vessel and drive the propeller directly from the engine, there are restrictions on the arrangement, the number, and the diameter, or the like, of the propellers. On the other hand, as the electrification of the marine vessel progresses, it becomes easy to adopt not only a shaft-driven propeller extending from a normal hull but also a POD type propeller or the like, and the above-described restriction becomes smaller. Therefore, an improvement in propulsion performance can be expected by determining an appropriate arrangement or the like.

Here, not only electrification but also generation of a propulsive force using a plurality of propellers is known (e.g., see JP 2005-526665 T, JP 2007-22447 A, and JP 62-95999 UM-A). For example, JP 2005-526665 T discloses a method in which a combination of a normal shaft-driven propeller and an azimuth-type propeller including an azimuth mechanism rotatable about a strut extending from a hull is used to change a propulsion system between cruising navigation and low-speed maneuvering, thereby improving maneuvering performance during low-speed maneuvering and reducing noise and vibration. In addition, JP 62-95999 UM-A discloses a technique for improving propulsion performance by changing the number of propellers to be driven depending on a draft state, by arranging a plurality of propellers at intervals in a vertical direction in a stern portion.

SUMMARY

However, in these examples, although a plurality of propellers are arranged, only partial improvement is aimed for in the entire operation of the marine vessel, such as improvement in maneuverability at low speed and optimization in accordance with draft.

The disclosure has been made to solve the above problem, and an object of the disclosure is to provide a marine vessel capable of improving propulsion efficiency for the entire operation of the marine vessel.

In order to solve the problems described above, a marine vessel according to the disclosure is a marine vessel that includes a hull and a propeller provided on a stern side of the hull, and the marine vessel has $n^2 D/\sqrt{(Bd)}$ of 4 or more and 35 or less, in a case where n is the number of the propeller, D is a diameter of the propeller, B is a water line breadth of the hull, and d is a draft of the hull.

Additionally, a marine vessel according to an embodiment of the disclosure includes a hull and a propeller provided on a stern side of the hull, and the marine vessel has $n \times \Sigma(D/\sqrt{(Bd)})$ of 4 or more and 35 or less, in a case where n is the number of the propeller, D is a diameter of the propeller, B is a water line breadth of the hull, and d is a draft of the hull.

According to the marine vessel of the disclosure, it is possible to improve propulsion efficiency for the entire operation of the marine vessel.

BRIEF DESCRIPTION OF DRAWINGS

The disclosure will be described with reference to the accompanying drawings, wherein like numbers reference like elements.

DESCRIPTION OF EMBODIMENTS

First Embodiment

A marine vessel according to a first embodiment of the disclosure will be described below with reference to FIGS. 1 to 5.

Configuration of Marine Vessel

Figure 1:
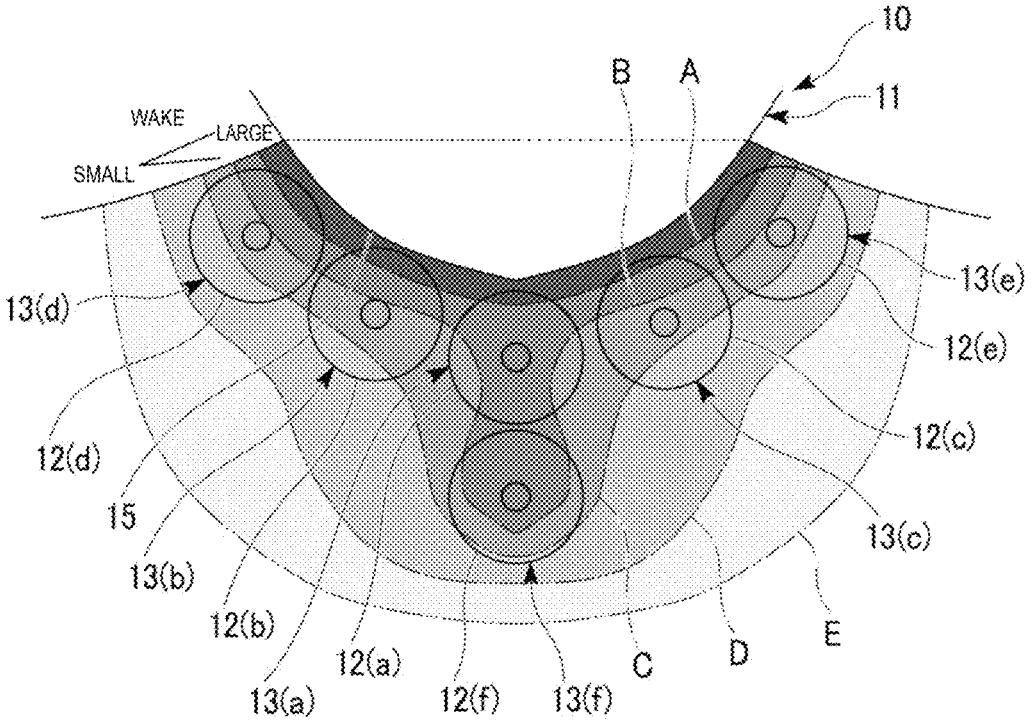
FIG. 1 is a schematic view of a lower portion of a marine vessel according to a first embodiment of the disclosure as viewed from a stern side.

A marine vessel 10 according to a first embodiment illustrated in FIG. 1 includes: a hull 11 and a plurality of, specifically, six similar propellers 12 provided on the stern side of the hull 11. Each of the six propellers 12 constitutes a POD type thruster 13. That is, a propeller 12(*a*) constitutes a POD type thruster 13(*a*), a propeller 12(*b*) constitutes a POD type thruster 13(*b*), a propeller 12(*c*) constitutes a POD type thruster 13(*c*), a propeller 12(*d*) constitutes a POD type thruster 13(*d*), a propeller 12(*e*) constitutes a POD type thruster 13(*e*), and a propeller 12(*f*) constitutes a POD type thruster 13(*f*). The POD type thruster 13 includes an electric motor built in a cocoon-shaped ellipsoidal body and rotates the propeller 12 by the electric motor. Specifically, the POD type thruster 13 is a POD type thruster of a hub drive type that drives a hub side of the propeller 12.

The six propellers 12 are aligned with each other in a front-back direction (length direction) of the hull 11. In other words, all the propellers 12 are disposed on the same plane orthogonal to the front-back direction of the hull 11. Therefore, the six POD type thrusters 13 are arranged symmetrically in a molded breadth direction of the hull 11 by aligning the positions in the front-back direction (length direction) of the hull 11.

The five propellers 12(*a*) to 12(*e*) of the six propellers 12 are disposed along the shape of a ship bottom 15 where the positions of the propellers 12(*a*) to 12(*e*) are aligned with a portion of the hull 11 in the front-back direction. The five propellers 12(*a*) to 12(*e*) are disposed symmetrically in the molded breadth direction of the hull 11. That is, one propeller 12(*a*) of the five propellers 12(*a*) to 12(*e*) is disposed at the center of the hull 11 in the molded breadth direction, two propellers 12(*b*) and 12(*c*) are disposed on both sides of the one propeller 12(*a*) in the molded breadth direction, and two propellers 12(*d*) and 12(*e*) are disposed on both sides of the entirety of the three propellers 12(*a*) to 12(*c*). The five propellers 12(*a*) to 12(*e*) are disposed at substantially the same distance from the ship bottom 15. Further, the remaining one propeller 12(*f*) of the six propellers 12 is disposed below the propeller 12(*a*) at the center in the molded breadth direction among the five propellers 12(*a*) to 12(*e*) so as to be aligned with the propeller 12(*a*) in the molded breadth direction.

In FIG. 1, velocity distribution of the wake are indicated by two-dot chain lines A to E below the ship bottom 15. The two-dot chain lines A to E illustrated on the lower side of the ship bottom 15 are lines connecting positions at which the speeds are equal to each other. In these two-dot chain lines A to E, the wake becomes larger as the line is closer to the ship bottom 15. The two-dot chain line A closest to the ship bottom 15 extends substantially along the ship bottom 15, and the next two-dot chain line B adjacent to the two-dot chain line A extends substantially along the ship bottom 15 on both sides in the molded breadth direction, but the center in the molded breadth direction protrudes downward. The next two-dot chain line C adjacent to the two-dot chain line B also extends substantially along the ship bottom 15 on both sides in the molded breadth direction, but the center in the molded breadth direction protrudes downward. Similarly, the next two-dot chain line D adjacent to the two-dot chain line C extends substantially along the ship bottom 15 on both sides in the molded breadth direction, but the center in the molded breadth direction slightly protrudes downward. The two-dot chain line E adjacent to the two-dot chain line D has a shape substantially extending along the ship bottom 15. Six propellers 12 are disposed in a range between the two-dot chain line C and the ship bottom 15, in accordance with the shape of the two-dot chain line C having a large wake. Since the efficiency is improved by installing the propeller 12 at a position where the wake generated from the hull 11 is large, the propeller 12 is arranged at a position where the wake at the stern is large.

Here, the ideal propeller efficiency is obtained from the relationship between the required thrust and a rotation circle area (propeller disk area) when the inflow velocity is equal, and it is said that the efficiency is better when the thrust per unit area is smaller. That is, for the same marine vessel, it is important to increase the propeller disk area by increasing the diameter of the propeller 12 as much as possible or increasing the number of propellers 12. Therefore, in the first embodiment, a plurality of, specifically six, propellers 12 are disposed on the stern side of the hull 11 as described above. The number of propellers 12 is preferably three or more.

Here, a parameter "$n^2D/\sqrt{(Bd)}$" is defined, where n is a number of the propellers 12, D is a diameter of the propeller 12, B is a water line breadth of the hull 11, and d is a draft of the hull 11.

The draft d is a draft d in any one of all operation states of the marine vessel 10, and is, for example, a full draft or a planned draft. Similarly, the water line breadth B of the hull 11 is a water line breadth in any one of all operation states of the marine vessel 10.

The parameter "$n^2D/\sqrt{(Bd)}$" is a parameter obtained by multiplying a numerical value by the number of the propeller 12, the numerical value being a product of a propeller disk ratio and the number of the propeller 12, the propeller disk ratio being a ratio of the area of the propeller 12 to the maximum area of the transverse cross-section of the hull 11 under the water surface.

The maximum area $S_1$ of the cross section of the hull 11 under the water surface is obtained as: $S_1=B\times d$.

Propeller disk area $S_2$ is obtained as: $S_2=n\times\pi D^2/4$.

The propeller disk ratio C is obtained as: $S_2/S_1=((\pi/4)\times nD^2)/(Bd)$.

When both sides are multiplied by the number of propellers, $S_2/S_1\times n=((\pi/4)\times nD^2)/(Bd)\times n$ is obtained.

From this equation, $\sqrt{(S_2/S_1\times n)}\times\sqrt{(4/\pi)}=nD/\sqrt{(Bd)}$ is obtained.

When both sides of this equation are further multiplied by the number of propellers, then $\sqrt{(S_2/S_1\times n)}\times\sqrt{(4/\pi)}\times n=n^2D/\sqrt{(Bd)}$ is obtained.

The right side of this equation is used as a parameter.

Figure 2:
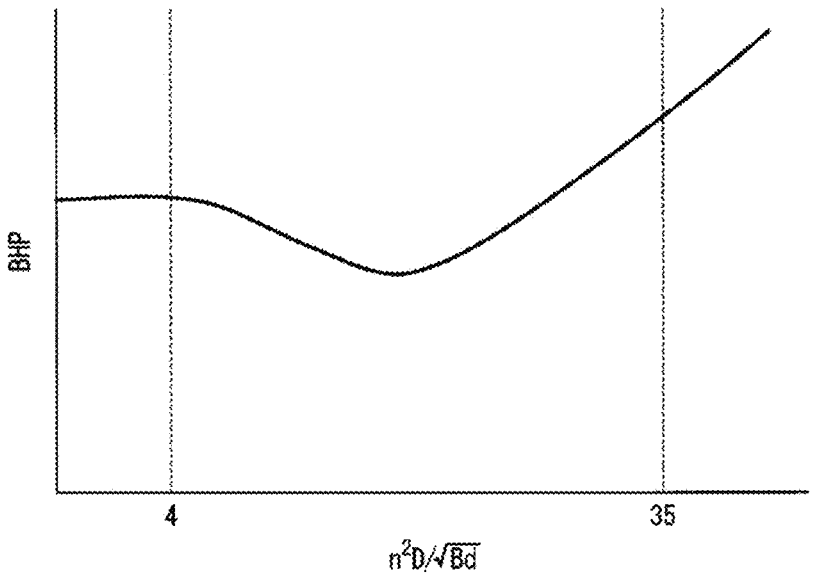
FIG. 2 is a characteristic curve illustrating a relationship between a parameter "$n^2D/\sqrt{(Bd)}$" and an output BHP of a marine vessel according to the first embodiment of the disclosure.
Figure 3:
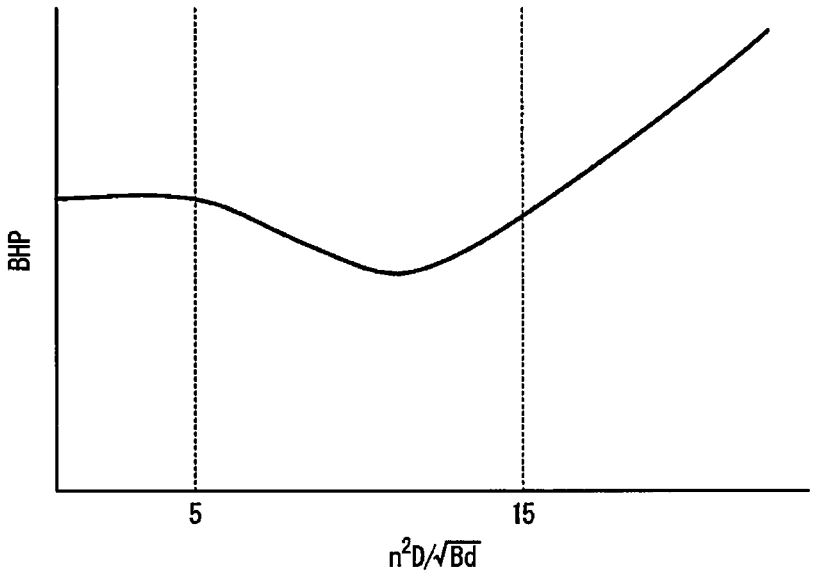
FIG. 3 is a characteristic curve illustrating a relationship between a parameter "$n^2D/\sqrt{(Bd)}$" and an output BHP of a marine vessel according to the first embodiment of the disclosure.
Figure 4:
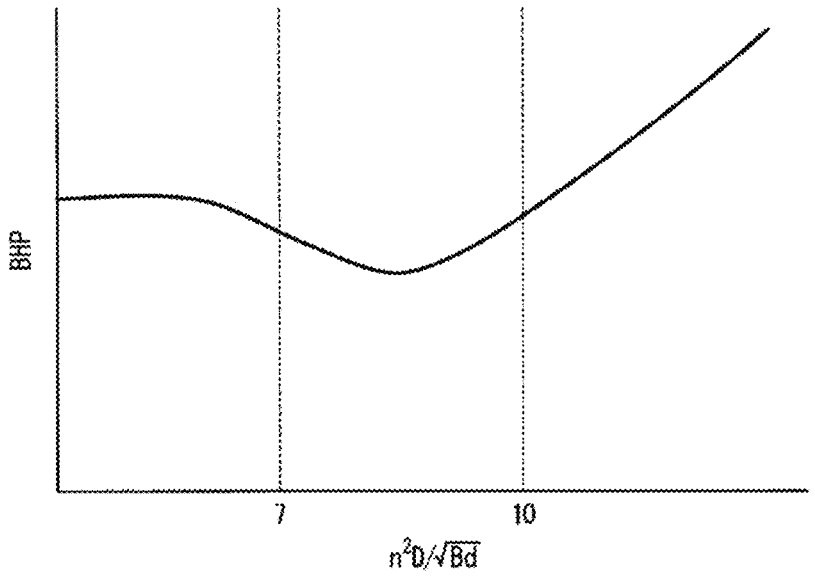
FIG. 4 is a characteristic curve illustrating a relationship between a parameter "$n^2D/\sqrt{(Bd)}$" and an output BHP of a marine vessel according to the first embodiment of the disclosure.

The relationship between the parameter "$n^2D/\sqrt{(Bd)}$" and the output BHP required for performing the predetermined same propulsion has characteristics illustrated in FIGS. 2 to 4. Since the output BHP is an output necessary for performing the same propulsion, a marine vessel having a higher propulsion efficiency can be obtained by performing the same propulsion even when the output BHP is small.

As illustrated in FIG. 2, when the parameter "$n^2D/\sqrt{(Bd)}$" is 4 or more, it is found that the output BHP is lower than when the parameter "$n^2D/\sqrt{(Bd)}$" is less than four. It can also be found that when the parameter "$n^2D/\sqrt{(Bd)}$" is 35 or less, the output BHP is lower than when the parameter "$n^2D/\sqrt{(Bd)}$" is greater than 35. From these results, it can be found that when the parameter "$n^2D/\sqrt{(Bd)}$" is 4 or more and 35 or less, the output BHP is effectively reduced and the propulsion efficiency can be improved.

In general, the propulsion efficiency can be improved by taking a large propeller disk area. In particular, it can be found that when the parameter "$n^2D/\sqrt{(Bd)}$" is 4 or more, the output BHP, which is substantially constant when the parameter is less than 4, starts to decrease, thereby increasing the propulsion efficiency. However, since there is an increase in resistance due to a drive system additive, the larger the propeller disk ratio does not necessarily improve the propulsion efficiency. As a result of studies on several marine vessel types, it was confirmed that a case where the parameter "$n^2D/\sqrt{(Bd)}$" is 35 or less is effective in reducing the output BHP.

As illustrated in FIG. 3, in particular, when the parameter "$n^2D/\sqrt{(Bd)}$" is 5 or more, the output BHP is lower than when the parameter "$n^2D/\sqrt{(Bd)}$" is less than 5. When the parameter "$n^2D/\sqrt{(Bd)}$" is 15 or less, the output BHP is lower than when the parameter "$n^2D/\sqrt{(Bd)}$" is greater than 15. When the parameter "$n^2D/\sqrt{(Bd)}$" is 5 or more and 15 or less, the output BHP is in a narrower range on the low side than when the parameter "$n^2D/\sqrt{(Bd)}$" is 4 or more and 35 or less. From these results, it can be found that when the parameter "$n^2D/\sqrt{(Bd)}$" is 5 or more and 15 or less, there is a further effect in reducing the output BHP, and the propulsion efficiency can be further improved.

As illustrated in FIG. 4, when the parameter "$n^2D/\sqrt{(Bd)}$" is 7 or more, the output BHP is lower than when the parameter "$n^2D/\sqrt{(Bd)}$" is less than 7. When the parameter "$n^2D/\sqrt{(Bd)}$" is 10 or less, the output BHP is lower than when the parameter "$n^2D/\sqrt{(Bd)}$" is greater than 10. When the parameter "$n^2D/\sqrt{(Bd)}$" is 7 or more and 10 or less, the output BHP is in a narrower range on the low side than when the parameter "$n^2D/\sqrt{(Bd)}$" is 5 or more and 15 or less. From these results, it can be found that when the parameter "$n^2D/\sqrt{(Bd)}$" is 7 or more and 10 or less, there is a further effect in reducing the output BHP, and the propulsion efficiency can be further improved.

Operational Effects

According to the marine vessel 10 of the first embodiment, the number of the propeller 12 and the area of the propeller 12 are set such that the parameter "$n^2D/\sqrt{(Bd)}$" is 4 or more and 35 or less. Thus, the propulsion efficiency can be improved for the entire operation of the marine vessel 10.

Here, in the marine vessel according to the first embodiment, when the number of the propeller 12 and the area of the propeller 12 are set such that the parameter "$n^2D/\sqrt{(Bd)}$" is 5 or more and 15 or less, it is possible to further improve the propulsion efficiency for the entire operation of the marine vessel 10.

In addition, in the marine vessel according to the first embodiment, when the number of the propellers 12 and the area of the propeller 12 are set such that the parameter "$n^2D/\sqrt{(Bd)}$" is 7 or more and 10 or less, it is possible to further improve the propulsion efficiency for the entire operation of the marine vessel 10.

Figure 5:
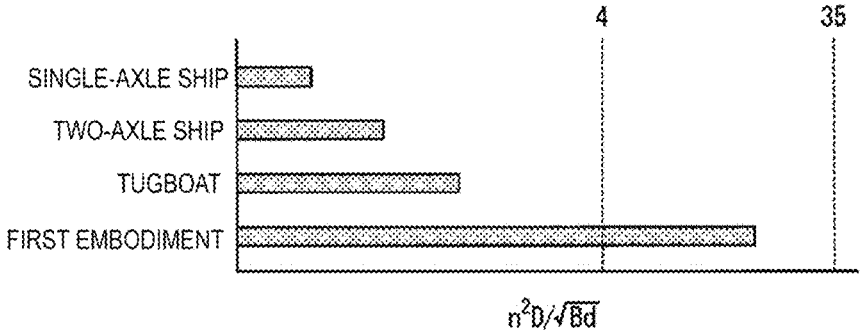
FIG. 5 is a graph illustrating a parameter "$n^2D/\sqrt{(Bd)}$" of a marine vessel according to the first embodiment of the disclosure and comparative examples.

FIG. 5 illustrates the results of comparing the parameters "$n^2D/\sqrt{(Bd)}$" between a single-axle ship with one propeller, a two-axle ship with two propellers, a tugboat, and the marine vessel 10 according to the first embodiment. In all of the single-axle ship, the two-axle ship, and the tugboat, the parameter "$n^2D/\sqrt{(Bd)}$" is less than four. The single-axle ship has the lowest parameter "$^2D/\sqrt{(Bd)}$" of less than 4, the two-axle ship is the next lowest, and the tugboat is the next lowest. As described above, the parameter "$n^2D/\sqrt{(Bd)}$" of each of the single-axle ship, the two-axle ship, and the tugboat is less than 4, while the parameter "$n^2D/\sqrt{(Bd)}$" of the first embodiment is 4 or more and falls within a range of 4 or more and 35 or less.

The propeller 12 may be a Fixed Pitch Propeller (FPP) or a Controllable Pitch Propeller (CPP). As described above, the propeller 12 constituting the POD type thruster 13 may be used, or a shaft-driven propeller that is driven through a shaft from a motor provided in the hull 11 may be used. The one or more propellers 12 may be driven by a motor located outside the hull 11, such as the POD type thruster 13.

In the marine vessel 10 according to the first embodiment, by installing a plurality of (3 or more) relatively small propellers 12, the efficiency by the wake can be improved, and by increasing the propeller disk area, the propeller efficiency can be improved. Thus, the propulsion efficiency can be improved for the entire operation of the marine vessel 10.

The propulsion efficiency of a marine vessel is determined by: the resistance of the hull, the propeller efficiency, and the mutual influence of the hull and the propeller, and there is a recent trend toward reducing the burden on the global environment, requiring unprecedented high efficiency. In addition, the regulation of exhaust gas for marine vessels is about to start, and these days, a shift is in progress from a diesel engine using light oil, which has been the mainstream solution, to a gas turbine and a steam turbine using a low-sulfur component fuel such as LNG. Among them, the propeller 12 is also electrified. Further, in a conventional engine-driven propeller 12, since it is necessary to arrange the engine in the marine vessel and drive the propeller directly from the engine, there are restrictions on the arrangement, the number, and the diameter, or the like, of the propellers. As the electrification of the marine vessel progresses, it becomes easy to adopt not only the shaft-driven propeller extending from a normal hull but also a POD type thruster or the like, the above-restriction becomes smaller, and the degree of freedom in the arrangement, the number, the diameter, or the like, of the propeller increases.

In the marine vessel 10 according to the first embodiment, since a plurality of relatively small propellers 12 are installed on the hull 11, it is suitable for electrifying with a high degree of freedom in the arrangement, the number, the diameter, or the like, of propellers 12. By setting the parameter "$n^2D/\sqrt{(Bd)}$" to fall within a predetermined range while reducing the burden on the global environment by electrifying the propeller 12, the propulsion efficiency can be improved for the entire operation of the marine vessel 10. In other words, the marine vessel 10 takes advantage of electrification for the entire operation.

Although the case where the diameters of a plurality of the propellers 12 are equal to each other has been described above, when the diameters of the plurality of propellers 12 are different from each other, a parameter "$n\times\Sigma(D/\sqrt{(Bd)})$" obtained by multiplying a numerical value (which is the product of the propeller disk area, with respect to the hull transverse cross-sectional area under the water surface, and the propeller number) by the propeller number is defined, where n is the number of the propellers 12, D is the diameter of the propeller 12, B is the water line breadth of the hull 11, and d is the draft of the hull 11. Also in this case, the marine vessel 10 has $n\times\Sigma(D/\sqrt{(Bd)})$ of 4 or more and 35 or less. Preferably, the marine vessel 10 has $n\times\Sigma(D/\sqrt{(Bd)})$ of 5 or more and 15 or less. More preferably, the marine vessel 10 has $n\times\Sigma(D/\sqrt{(Bd)})$ of 7 or more and 10 or less.

For example, in case of a marine vessel 10 including: two propellers 12 with B=50 m, d=10 m, D=6 m; and four propellers 12 with D=4 m, the next equation is obtained: $n\times\Sigma(D/\sqrt{(Bd)})=(2+4)\times\{6/\sqrt{(50\times10)}+6/\sqrt{(50\times10)}+4/\sqrt{(50\times10)}+4/\sqrt{(50\times10)}+4/\sqrt{(50\times10)}+4/\sqrt{(50\times10)}\}=7.51$.

Second Embodiment

A marine vessel according to a second embodiment of the disclosure will be described focusing on differences from the first embodiment mainly with reference to FIGS. 6 to 8.

Configuration of Marine Vessel

Figure 6:
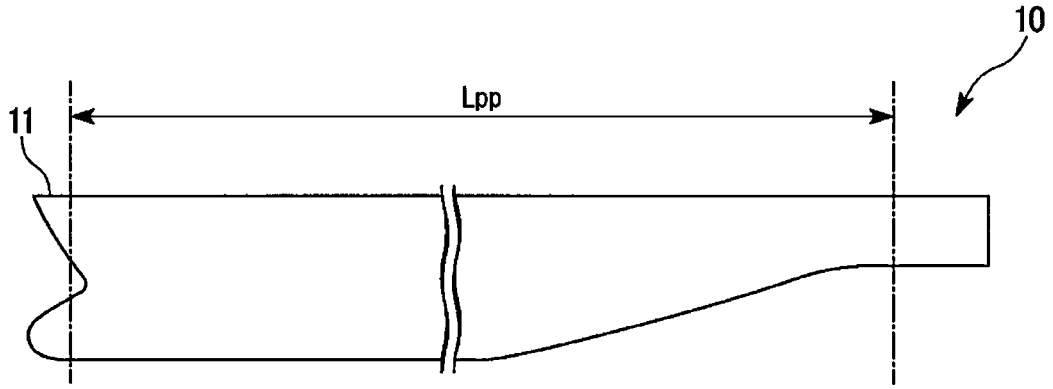
FIG. 6 is a schematic side view of a marine vessel according to a second embodiment of the disclosure.
Figure 7:
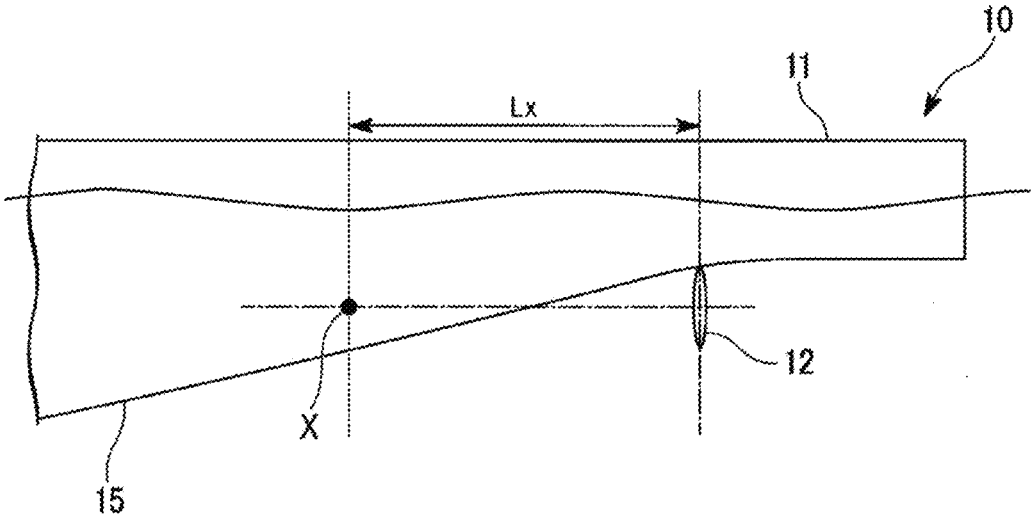
FIG. 7 is a schematic side view illustrating a stern side of a marine vessel according to the second embodiment of the disclosure.

For the marine vessel 10 according to the second embodiment, as illustrated in FIGS. 6 and 7, the extension lines of the rotation central axes of all the propellers 12 are located within the range of the hull 11 located on a bow side from the positions of the propellers 12, by a length Lx of 12.5% of the length between perpendiculars (Lpp) of the hull 11. In other words, the rotation central axes of all the propellers 12 overlap, by the length Lx, the shape of the hull 11 located upstream from the installation position of the propeller 12. In other words, for all the propellers 12, a point X extending from each installation position toward the bow side by the length Lx on the extension line of each rotation central axis line is within the range of the cross section of the hull 11 on a plane including the point X and extending in a vertical direction and the molded breadth direction.

Here, the propeller 12 has a characteristic that the performance is improved when it is installed in a place where it receives a large wake. The wake largely depends on the boundary layer generated in the hull 11, and there is a large correlation between the shape of the hull 11 and the wake distribution.

Figure 8:
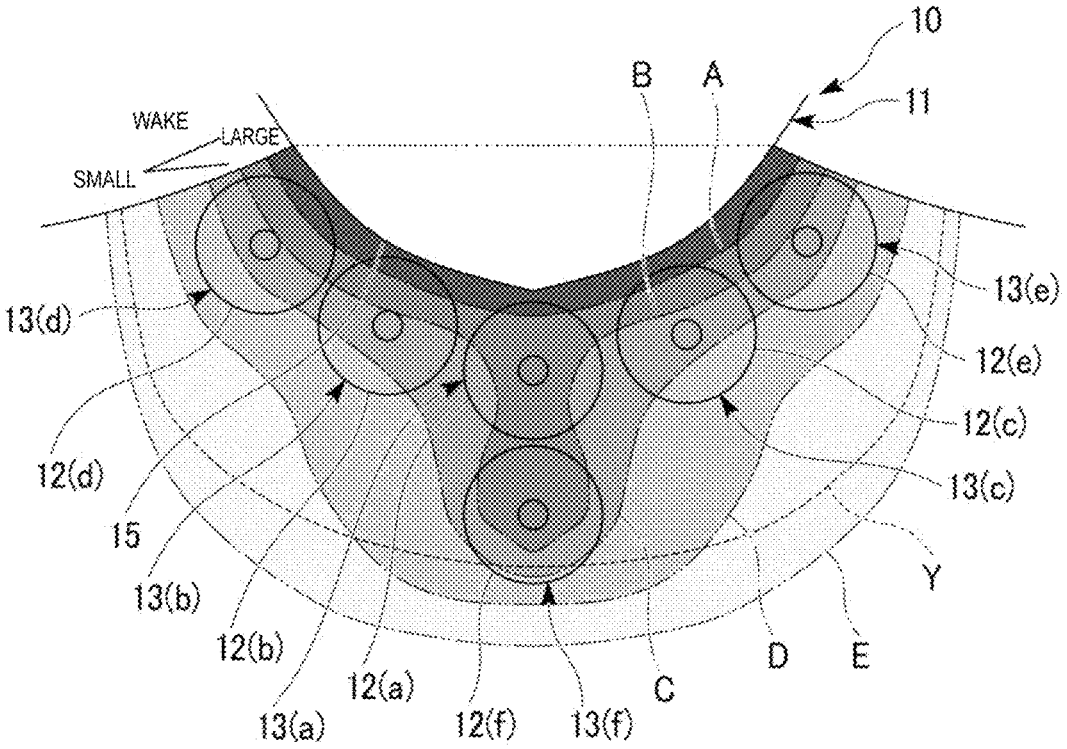
FIG. 8 is a schematic view of a lower portion of a marine vessel according to the second embodiment of the disclosure as viewed from the stern side.

In FIG. 8, similarly to FIG. 1, velocity distribution of the wake is indicated by the two-dot chain lines A to E below the ship bottom 15. In addition, in FIG. 8, an example of the shape of the hull 11 located 12.5% of the length between perpendiculars Lpp upstream from the positions of the propellers 12(*a*) to 12(*f*) is indicated by a dashed line Y. As a result of studies on several marine vessel types, as in the example indicated by the dashed line Y in FIG. 8, it was found that the wake flowing into the propellers 12(*a*) to 12(*f*) has a strong correlation with the shape of the ship bottom 15 of the hull 11 located 12.5% of the length between perpendiculars Lpp upstream from the positions of the propellers 12(*a*) to 12(*f*).

For this reason, for the marine vessel 10 according to the second embodiment, all of the propellers 12(*a*) to 12(*f*) are disposed such that the extension lines of the rotation central axes are located within a range of the hull 11 located on the bow side by the length Lx of 12.5% of the length between perpendiculars Lpp of the marine vessel 10, from the respective positions.

Operational Effects

According to the marine vessel 10 of the second embodiment, since the efficiency by the wake can be further improved, the propulsion efficiency can be further improved for the entire operation of the marine vessel 10.

Third Embodiment

Figure 9:
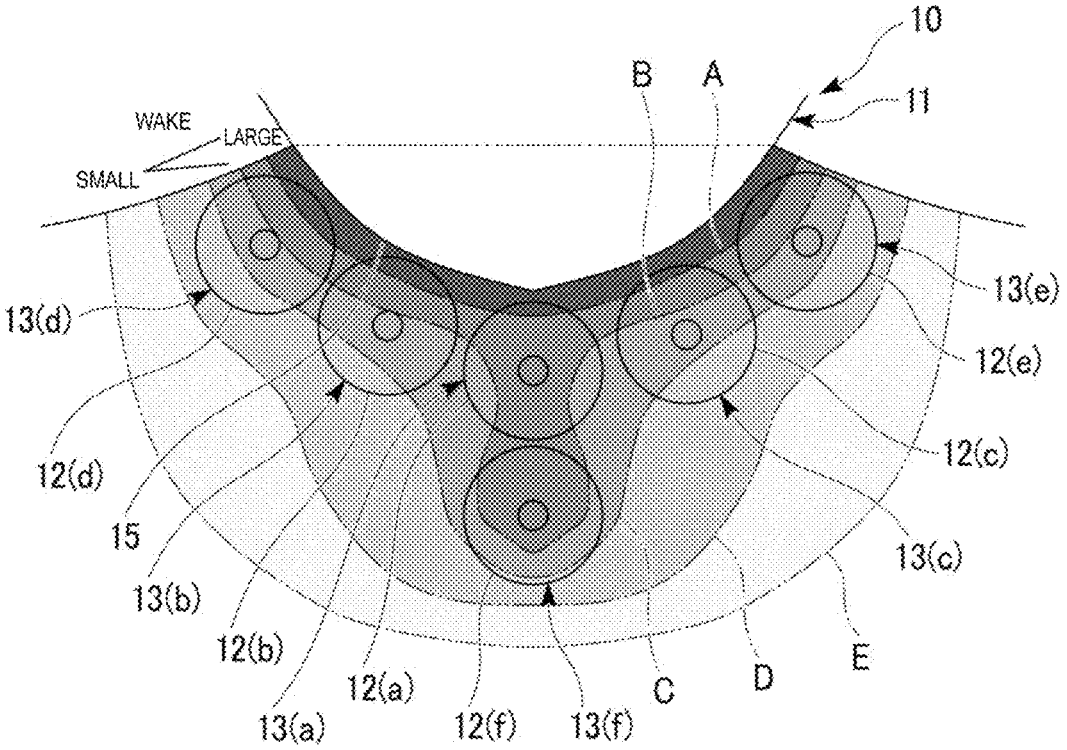
FIG. 9 is a schematic view of a lower portion of a marine vessel according to a third embodiment of the disclosure as viewed from a stern side.
Figure 10:
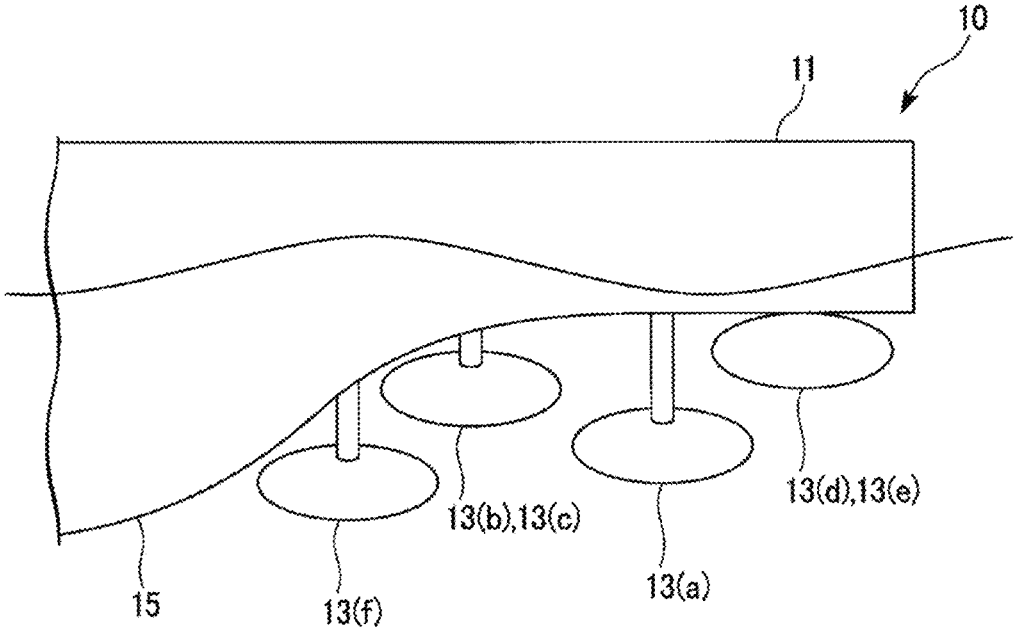
FIG. 10 is a schematic side view illustrating the stern side of a marine vessel according to the third embodiment of the disclosure.

A marine vessel according to a third embodiment of the disclosure will be described focusing on differences from the first and second embodiments mainly with reference to FIGS. 9 and 10.

Configuration of Marine Vessel

In the first and second embodiments, all of the propellers 12 are disposed on the same plane orthogonal to the front-back direction of the hull 11. However, the third embodiment is changed from the first and second embodiments in that the plurality of propellers 12 are shifted in position in the front-back direction of the hull 11.

Also in the third embodiment, each of the plurality of propellers 12 constitutes POD type thruster 13 of a hub drive type that drives the hub side of the propeller 12. As illustrated in FIG. 10, a plurality of the POD type thrusters 13(*a*) to 13(*f*) each having the propeller 12 are arranged so as to be shifted in the front-back direction of the hull 11. That is, for the POD type thrusters 13(*a*) to 13(*f*), the POD type thruster 13(*f*) is disposed on the most bow side, the POD type thrusters 13(*b*) and 13(*c*) are disposed on the stern side of the POD type thruster 13(*f*), the POD type thruster 13(*a*) is disposed on the stern side of the POD type thrusters 13(*b*) and 13(*c*), and the POD type thrusters 13(*d*) and 13(*e*) are disposed on the stern side of the POD type thruster 13(*a*). As a result, the plurality of propellers 12(*a*) to 12(*f*) illustrated in FIG. 9 are also shifted in position in the front-back direction of the hull 11 in the same manner as the POD type thrusters 13(*a*) to 13(*f*). The plurality of propellers 12(*a*) to 12(*f*) are disposed so as to be shifted in position in the front-back direction of the hull 11 so as to improve efficiency under wake from the hull 11.

Operational Effects

According to the marine vessel 10 of the third embodiment, since the plurality of propellers 12 are shifted in position in the front-back direction of the hull 11, the plurality of propellers 12 can be efficiently disposed at locations where the wake from the hull 11 is large, and the influence of mutual interference between the propellers 12 can be eliminated or effectively used.

Fourth Embodiment

Figure 11:
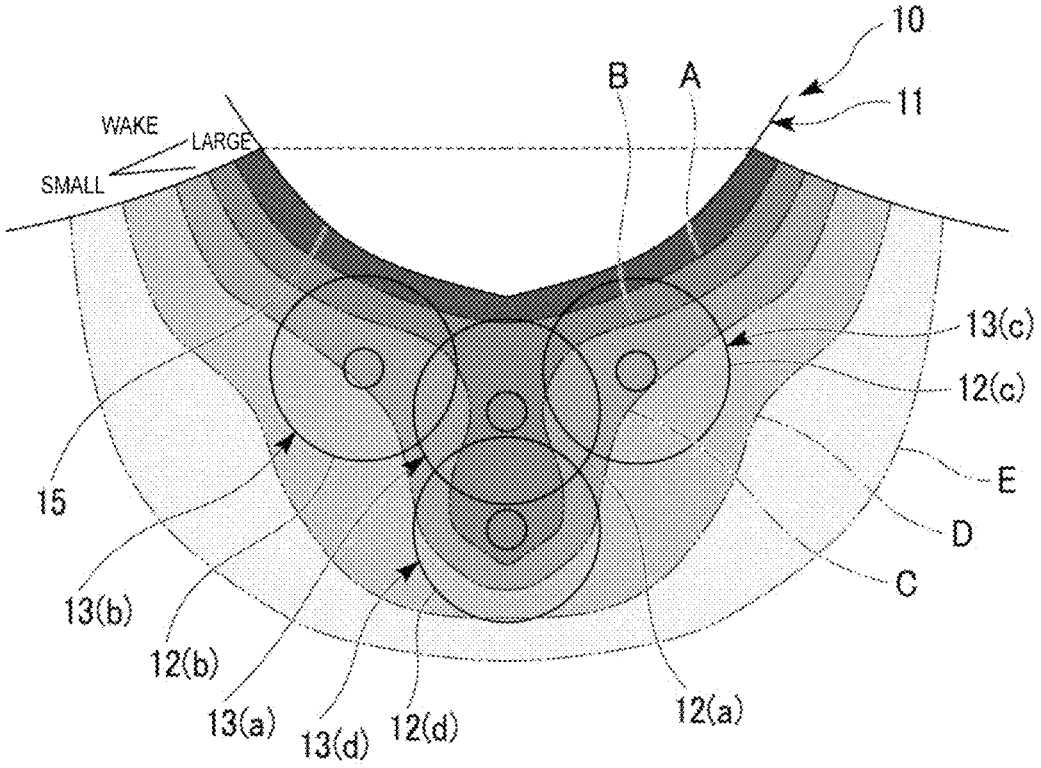
FIG. 11 is a schematic view of a lower portion of a marine vessel according to a fourth embodiment of the disclosure as viewed from a stern side.
Figure 12:
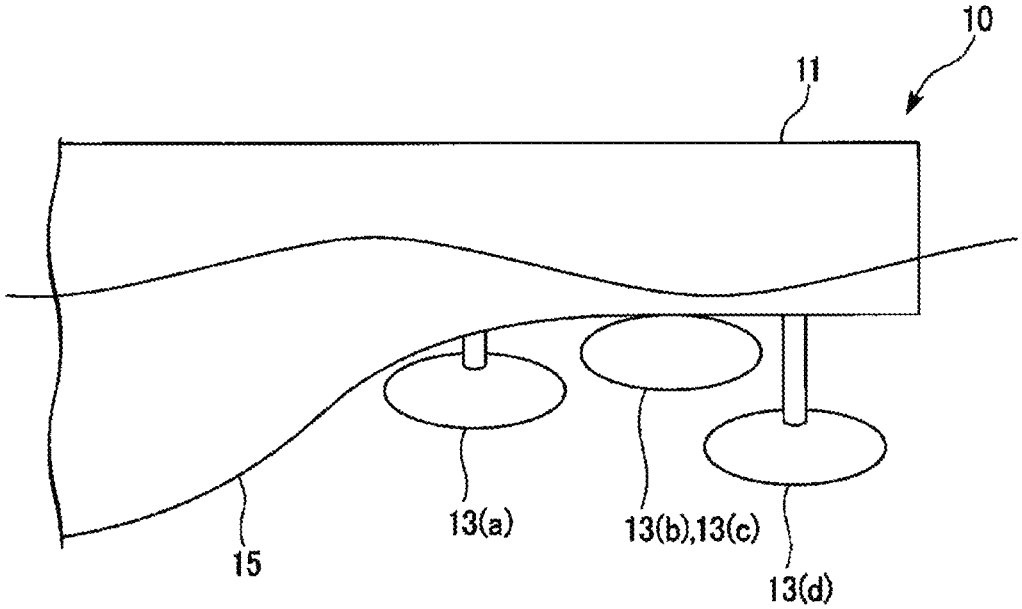
FIG. 12 is a schematic side view illustrating the stern side of a marine vessel according to the fourth embodiment of the disclosure.

A marine vessel according to a fourth embodiment of the disclosure will be described focusing on differences from the first to third embodiments mainly with reference to FIGS. 11 and 12.

Configuration of Marine Vessel

A fourth embodiment is different from the third embodiment in that the plurality of propellers 12 partially overlap each other in at least one of the molded breadth direction and the vertical direction of the hull 11. In other words, in the fourth embodiment, the plurality of propellers 12 are disposed so as to overlap each other in at least one of the molded breadth direction and the vertical direction of the hull 11.

In the fourth embodiment, specifically, four propellers 12 are provided symmetrically in the molded breadth direction, and three propellers 12 are provided at the center in the molded breadth direction on the hull 11 side and on both sides thereof. That is, the propeller 12(*a*) is provided at the center in the molded breadth direction on the hull 11 side, and the propellers 12(*b*) and 12(*c*) are provided on both sides of the propeller 12(*a*) on the hull 11 side. The three propellers 12(*a*) to 12(*c*) have substantially the same distance from the ship bottom 15. Among the three propellers 12(*a*) to 12(*c*), one propeller 12(*d*) is provided vertically below the propeller 12(*a*) at the center in the molded breadth direction.

The three propellers 12(*a*) to 12(*c*) on the hull 11 side overlap each other in the vertical direction. Among the three propellers 12(*a*) to 12(*c*) on the hull 11 side, the propeller 12(*a*) at the center in the molded breadth direction overlaps in the molded breadth direction the propeller 12(*b*) adjacent thereto on one side in the molded breadth direction and also overlaps in the molded breadth direction the propeller 12(*c*) adjacent thereto on the other side in the molded breadth direction. Among the three propellers 12(*a*) to 12(*c*) on the hull 11 side, the propellers 12(*b*) and 12(*c*) on both outer sides in the molded breadth direction do not overlap each other in the molded breadth direction, but overlap each other only in the vertical direction. When the three propellers 12(*a*) to 12(*c*) on the side of the hull 11 are viewed along their rotation central axes, the propeller 12(*a*) at the center in the molded breadth direction and the propeller 12 *b*) adjacent thereto on one side in the molded breadth direction appear to overlap, and the propeller 12(*a*) at the center in the molded breadth direction and the propeller 12(*c*) adjacent thereto on the other side in the molded breadth direction appear to overlap, while the propellers 12(*b*) and 12(*c*) on both outer sides in the molded breadth direction do not appear to overlap.

In addition, the propeller 12(*a*) at the center in the molded breadth direction on the hull 11 side and the propeller 12(*d*) vertically below the propeller 12(*a*) overlap in both the molded breadth direction and the vertical direction. The propeller 12(*a*) on the hull 11 side and at the center in the molded breadth direction and the propeller 12(*d*) vertically below the propeller 12(*a*) appear to overlap when viewed along the direction of their rotation central axes. The propeller 12(*d*) on the lower side of the center in the molded breadth direction overlaps the propellers 12(*b*) and 12(*c*) (which are located on the hull 11 side and on both outer sides in the molded breadth direction) in both the molded breadth direction and the vertical direction, but does not appear to overlap each other even when viewed along the direction of these rotation central axes.

According to the fourth embodiment, each of the plurality of propellers 12 constitutes the POD type thruster 13. That is, the propeller 12(*a*) constitutes the POD type thruster 13(*a*), the propeller 12(*b*) constitutes the POD type thruster 13(*b*), the propeller 12(*c*) constitutes the POD type thruster 13(*c*), and the propeller 12(*d*) constitutes the POD type thruster 13(*d*). Similarly to the propellers 12(*a*) to 12(*d*), the plurality of POD type thrusters 13(*a*) to 13(*d*) each having the propeller 12 partially overlap in at least one of the molded breadth direction and the vertical direction. As illustrated in FIG. 12, the POD thrusters 13(*a*) to 13(*d*) are disposed such that the POD type thruster 13(*a*) is disposed on the most bow side, the POD type thrusters 13(*b*) and 13(*c*) are disposed on the stern side of the POD type thruster 13(*a*), and the POD type thruster 13(*d*) is disposed on the stern side of the POD type thrusters 13(*b*) and 13(*c*). As a result, the plurality of propellers 12(*a*) to 12(*d*) illustrated in FIG. 11 are also shifted in position in the front-back direction of the hull 11 in the same manner as the POD type thrusters 13(*a*) to 13(*d*).

Operational Effects

According to the marine vessel 10 of the fourth embodiment, the plurality of propellers 12 are displaced in the front-back direction of the hull 11 and are overlapped in at least one of the molded breadth direction and the vertical direction of the hull 11, so that the plurality of propellers 12 can be efficiently disposed in a place where the wake from the hull 11 is large, and one propeller 12 disposed behind another propeller recovers the swirl flow generated from the other propeller 12 to function as a Contra Rotating Propeller (CRP), thereby achieving high efficiency.

Fifth Embodiment

A marine vessel according to a fifth embodiment of the disclosure will be described focusing on differences from the first to fourth embodiments mainly with reference to FIG. 13.

Configuration of Marine Vessel

The fifth embodiment is changed from the first to fourth embodiments in that the plurality of propellers include: a shaft-driven propeller 21 driven by an electric motor provided in the hull 11 through a shaft; and a propeller 12 (not illustrated in FIG. 13) constituting the POD type thruster 13. In other words, the plurality of propellers are a combination of the shaft-driven propeller 21 and the propeller 12 (not illustrated in FIG. 13) of the POD type thrusters 13.

Figure 13:
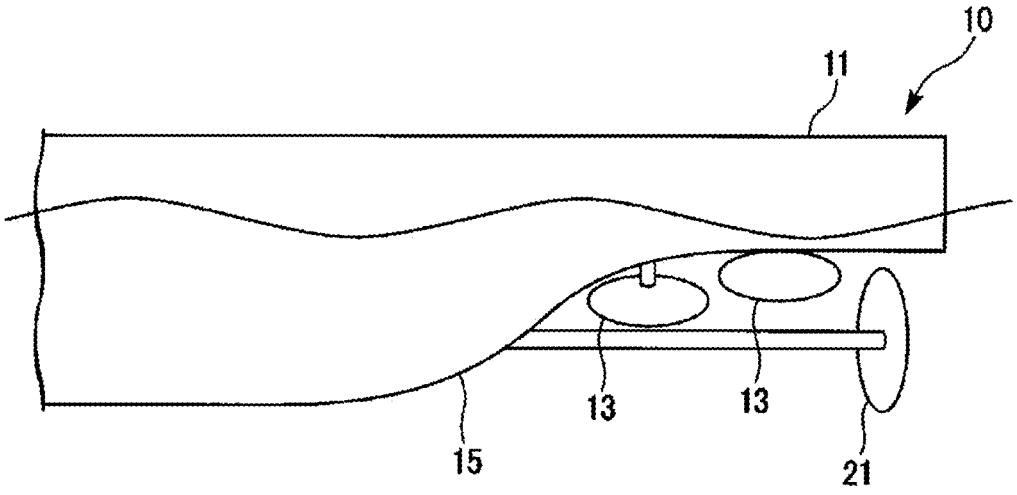
FIG. 13 is a schematic side view illustrating a stern side of a marine vessel according to a fifth embodiment of the disclosure.

In FIG. 13, as an example, the shaft-driven propeller 21 is provided instead of one of the POD type thrusters 13 of the fourth embodiment. Specifically, among the four propellers 12 of the fourth embodiment, the shaft-driven propeller 21 is provided instead of the propeller 12 of the POD type thruster 13 on the lower side of the center in the molded breadth direction. Therefore, the plurality of POD type thrusters 13 are provided on the hull 11 side, and the shaft-driven propeller 21 is provided below the POD type thrusters 13.

Operational Effects

The propeller 12 (not illustrated in FIG. 13) of the POD type thruster 13 includes a drive unit such as a motor extending to the outside of the hull 11, which causes to increase the ship resistance. According to the marine vessel 10 of the fifth embodiment, by using the shaft-driven propeller 21 and the POD type thruster 13 in combination, it is possible to design the marine vessel in consideration of a balance between an increase in resistance and an increase in propeller efficiency. For example, it is possible to suppress an increase in resistance by using the shaft-driven propeller 21 for a portion where a shaft can be extended from the hull 11 and by using the POD type thruster 13 only for a portion where it is difficult to extend the shaft. Therefore, since an increase in resistance due to the POD type thruster 13 can be suppressed, the propulsion performance can be improved.

Sixth Embodiment

A marine vessel according to a sixth embodiment of the disclosure will be mainly described focusing on differences from the first to fifth embodiments.

Configuration of Marine Vessel

The sixth embodiment is different from the first to fifth embodiments in that one or more of the plurality of POD type thrusters 13 includes an azimuth mechanism rotatable about a strut extending from the hull 11. In other words, at least one of the plurality of propellers 12 constitutes the POD type thruster 13 including the azimuth mechanism. For example, as in the fifth embodiment, even in the case of a combination of the shaft-driven propeller 21 driven by a motor provided in the hull 11 through a shaft and the POD type thrusters 13, at least one of the plurality of POD type thrusters 13 may each include a rotatable azimuth mechanism.

Operational Effects

According to the marine vessel 10 of the sixth embodiment, the turning performance can be improved by providing the azimuth mechanism in each of one or more POD type thrusters 13. For example, when this makes a rudder unnecessary, the hull resistance will decrease, and it is possible to aim for further improvement in propulsion performance. In addition, it is possible to obtain great merits even when maneuvering in a port.

Seventh Embodiment

Figure 14:
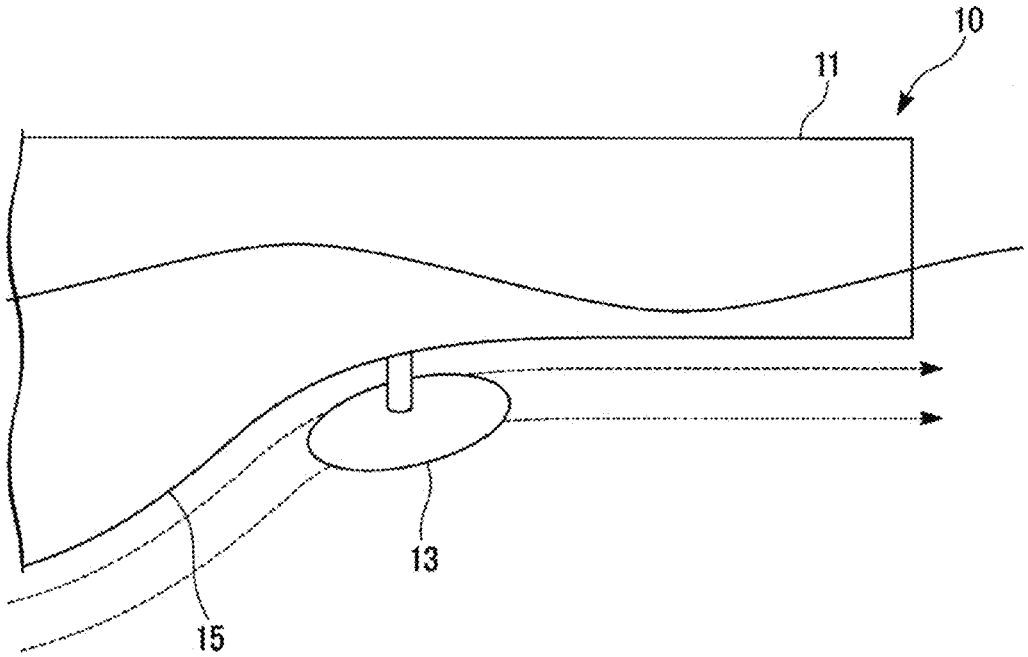
FIG. 14 is a schematic side view illustrating a stern side of a marine vessel according to a seventh embodiment of the disclosure.

A marine vessel according to a seventh embodiment of the disclosure will be described focusing on differences from the first to sixth embodiments mainly with reference to FIG. 14.

Configuration of Marine Vessel

For the seventh embodiment, compared to the first to sixth embodiments, one or more of the plurality of POD type thrusters 13 are inclined in the vertical direction so as to be positioned higher toward the stern side. As a result, the propeller 12 (not illustrated in FIG. 14) of the inclined POD type thruster 13 is also inclined in the vertical direction so that the rotation central axis thereof is positioned higher toward the stern side. In FIG. 14, a single POD type thruster 13 is extracted from the plurality of POD type thrusters 13.

In other words, the POD type thruster 13 is inclined so as to be positioned higher toward the stern side along the shape of the hull 11. The POD type thruster 13 is inclined along the roll-up flow in accordance with the roll-up flow from the hull 11. Since the POD type thruster 13 is inclined in this manner, the rotation central axis of the propeller 12 (not illustrated in FIG. 14) is also inclined so as to be positioned higher toward the stern side so as to follow the shape of the hull 11 and is inclined so as to follow the roll-up flow in accordance with the roll-up flow from the hull 11.

Operational Effects

According to the marine vessel 10 of the seventh embodiment, one or more POD type thrusters 13 are provided so as to be inclined such that the rotation central axis of the propeller 12 is positioned higher toward the stern side. Thus, the rotation central axis of the propeller 12 can be aligned with the roll-up flow from the hull 11, thereby improving propeller efficiency. In addition, by applying the flow velocity to the vicinity of the ship bottom, the frictional resistance of the ship bottom can be reduced.

Eighth Embodiment

A marine vessel according to an eighth embodiment of the disclosure will be described focusing on differences from the first to seventh embodiments.

Configuration of Marine Vessel

For the eighth embodiment, compared to the first to seventh embodiments, the plurality of propellers 12 are configured such that the number of the propellers to be driven is changed according to the operation mode. For example, several propellers 12 are stopped in a light load state, or several propellers 12 are stopped during low-speed operation such as in a port.

Operational Effects

According to the marine vessel 10 of the eighth embodiment, optimum propeller operation is possible, and the main engine output can be optimized in accordance with the operation mode.

In the above first to eighth embodiments, as the POD type thruster 13, POD type thruster 13 of a hub drive type for driving the hub side, which is the rotation central side of the propeller 12, has been described as an example. It is also possible to use POD type thruster of a rim drive type that drives a rim side, which is the outer peripheral side of the propeller.

Notes

The marine vessel 10 according to each embodiment of the disclosure is grasped as follows, for example.

(1) A marine vessel 10 according to a first aspect is a marine vessel 10, which includes a hull 11 and a propeller 12, 21 provided on a stern side of the hull 11 and has $n^2D/\sqrt{(Bd)}$ of 4 or more and 35 or less, in a case where n is the number of the propeller 12, 21, D is a diameter of the propeller 12, 21, B is a water line breadth of the hull 11, and d is a draft of the hull 11.

According to this marine vessel 10, it is possible to improve propulsion efficiency for the entire operation.

(2) A marine vessel 10 according to a second aspect is the marine vessel 10 according to (1), where the $n^2D/\sqrt{(Bd)}$ is 5 or more and 15 or less.

According to this marine vessel 10, it is possible to further improve the propulsion efficiency for the entire operation.

(3) A marine vessel 10 according to a third aspect is the marine vessel 10 according to (2), where the $n^2D/\sqrt{(Bd)}$ is 7 or more and 10 or less.

According to this marine vessel 10, it is possible to further improve the propulsion efficiency for the entire operation.

(4) A marine vessel 10 according to a fourth aspect is a marine vessel 10, which includes a hull 11 and a propeller 12, 21 provided on a stern side of the hull 11 and has $n\times\Sigma(D/\sqrt{(Bd)})$ of 4 or more and 35 or less, in a case where n is the number of the propeller 12, 21, D is a diameter of the propeller 12, 21, B is a water line breadth of the hull 11, and d is a draft of the hull 11.

According to this marine vessel 10, it is possible to improve propulsion efficiency for the entire operation.

(5) A marine vessel 10 according to a fifth aspect is the marine vessel 10 according to (4), where the $n\times\Sigma(D/\sqrt{(Bd)})$ is 5 or more and 15 or less.

According to this marine vessel 10, it is possible to further improve the propulsion efficiency for the entire operation.

(6) A marine vessel 10 according to a sixth aspect is the marine vessel 10 according to (5), where the $n\times\Sigma(D/\sqrt{(Bd)})$ is 7 or more and 10 or less.

According to this marine vessel 10, it is possible to further improve the propulsion efficiency for the entire operation.

(7) A marine vessel 10 according to a seventh aspect is the marine vessel 10 according to any one of (1) to (6), where an extension line of a rotation central axis of the propeller 12, 21 is located within a range of the hull 11 located on a bow side from a position of the propeller 12, 21, by a length of 12.5% of a length between perpendiculars Lpp of the hull 11.

According to this marine vessel 10, since the efficiency by the wake can be further improved, the propulsion efficiency can be further improved for the entire operation.

(8) A marine vessel 10 according to an eighth aspect is the marine vessel 10 according to any one of (1) to (7), where the propeller includes a plurality of the propellers 12, 21, and a position of one of the propellers 12, 21 is shifted from a position of another of the propellers 12, 21 in a front-back direction of the hull 11.

According to this marine vessel 10, the plurality of propellers 12, 21 can be efficiently disposed in a place where the wake from the hull 11 is large, and the influence of mutual interference between the propellers 12, 21 can be eliminated or effectively used.

(9) A marine vessel 10 according to a ninth aspect is the marine vessel 10 according to any one of (1) to (8), where the propeller includes a plurality of propellers 12, 21, and a position of one of the propellers 12, 21 and a position of another of the propellers 12, 21 partially overlap each other in at least one of a molded breadth direction and a vertical direction of the hull 11.

According to this marine vessel 10, the plurality of propellers 12, 21 can be efficiently disposed in a place where the wake from the hull 11 is large, and one propeller 12, 21 disposed behind another propeller 12, 21 recovers the swirl flow generated from the other propeller 12, 21 to function as a Contra Rotating Propeller (CRP), thereby achieving high efficiency.

(10) A marine vessel 10 according to a tenth aspect is the marine vessel 10 according to any one of (1) to (9), where the propeller includes a plurality of the propellers 12, 21 that include a shaft-driven propeller 21 and a propeller 12 constituting a POD type thruster 13.

According to this marine vessel 10, by using the shaft-driven propeller 21 and the POD type thruster 13 in combination, it is possible to design the marine vessel in consideration of a balance between an increase in resistance and an increase in propeller efficiency.

(11) A marine vessel 10 according to an eleventh aspect is the marine vessel 10 according to any one of (1) to (10), where the propeller 12 constitutes a POD type thruster 13 including an azimuth mechanism.

According to this marine vessel 10, the turning performance can be improved by providing the azimuth mechanism in the POD type thruster 13.

(12) A marine vessel 10 according to a twelfth aspect is the marine vessel 10 according to any one of (1) to (11), where the propeller 12, 21 is provided so as to be inclined such that a rotation central axis of the propeller 12, 21 is positioned on an upper side toward a stern side.

According to this marine vessel 10, the rotation central axis of the propeller 12, 21 can be aligned with the roll-up flow from the hull 11, thereby improving propeller efficiency.

(13) A marine vessel 10 according to a thirteenth aspect is the marine vessel 10 according to any one of (1) to (12), where the propeller includes a plurality of the propellers 12, 21, and the number of the plurality of propellers 12, 21 to be driven is changed in accordance with an operation mode.

According to the marine vessel 10, optimum propeller operation is possible, and the main engine output can be optimized in accordance with the operation mode.

While preferred embodiments of the invention have been described as above, it is to be understood that variations and modifications will be apparent to those skilled in the art without departing from the scope and spirit of the invention. The scope of the invention, therefore, is to be determined solely by the following claims.

The invention claimed is:

1. A marine vessel comprising:
a hull; and
a propeller provided on a stern side of the hull,
wherein
$n^2D/\sqrt{(Bd)}$ is 4 or more and 35 or less, in a case where
n is the number of the propeller,
D is a diameter of the propeller,
B is a water line breadth of the hull, and
d is a draft of the hull.

2. The marine vessel according to claim 1, wherein the $n^2D/\sqrt{(Bd)}$ is 5 or more and 15 or less.

3. The marine vessel according to claim 2, wherein the $n^2D/\sqrt{(Bd)}$ is 7 or more and 10 or less.

4. A marine vessel comprising:
a hull; and
a propeller provided on a stern side of the hull,
wherein
$n\times\Sigma(D/\sqrt{(Bd)})$ is 4 or more and 35 or less, in a case where
n is the number of the propeller,
D is a diameter of the propeller,
B is a water line breadth of the hull, and
d is a draft of the hull.

5. The marine vessel according to claim 4, wherein the $n\times\Sigma(D/\sqrt{(Bd)})$ is 5 or more and 15 or less.

6. The marine vessel according to claim 5, wherein the $n\times\Sigma(D/\sqrt{(Bd)})$ is 7 or more and 10 or less.

7. The marine vessel according to claim 1, wherein an extension line of a rotation central axis of the propeller is located within a range of the hull located on a bow side from a position of the propeller, by a length of 12.5% of a length between perpendiculars Lpp of the hull.

8. The marine vessel according to claim 1, wherein the propeller includes a plurality of the propellers, and a position of one of the propellers is shifted from a position of another of the propellers in a front-back direction of the hull.

9. The marine vessel according to claim 1, wherein the propeller includes a plurality of the propellers, and a position of one of the propellers and a position of another of the propellers partially overlap each other in at least one of a molded breadth direction and a vertical direction of the hull.

10. The marine vessel according to claim 1, wherein the propeller includes a plurality of the propellers that include a shaft-driven propeller and a propeller constituting a POD type thruster.

11. The marine vessel according to claim 1, wherein the propeller constitutes a POD type thruster including an azimuth mechanism.

12. The marine vessel according to claim 1, wherein the propeller is provided so as to be inclined such that a rotation central axis of the propeller is positioned on an upper side toward a stern side.

13. The marine vessel according to claim 1, wherein the propeller includes a plurality of the propellers, and the number of the plurality of propellers to be driven is changed in accordance with an operation mode.

14. The marine vessel according to claim 4, wherein an extension line of a rotation central axis of the propeller is located within a range of the hull located on a bow side from a position of the propeller, by a length of 12.5% of a length between perpendiculars Lpp of the hull.

15. The marine vessel according to claim 4, wherein the propeller includes a plurality of the propellers, and a position of one of the propellers is shifted from a position of another of the propellers in a front-back direction of the hull.

16. The marine vessel according to claim 4, wherein the propeller includes a plurality of the propellers, and a position of one of the propellers and a position of another of the propellers partially overlap each other in at least one of a molded breadth direction and a vertical direction of the hull.

17. The marine vessel according to claim 4, wherein the propeller includes a plurality of the propellers that include a shaft-driven propeller and a propeller constituting a POD type thruster.

18. The marine vessel according to claim 4, wherein the propeller constitutes a POD type thruster including an azimuth mechanism.

19. The marine vessel according to claim 4, wherein the propeller is provided so as to be inclined such that a rotation central axis of the propeller is positioned on an upper side toward a stern side.

20. The marine vessel according to claim 4, wherein the propeller includes a plurality of the propellers, and the number of the plurality of propellers to be driven is changed in accordance with an operation mode.

* * * * *